US005446942A

United States Patent [19]

Whitehorn

[11] Patent Number: 5,446,942

[45] Date of Patent: Sep. 5, 1995

[54] STEAM CLEANING ASSEMBLY FOR CLEANING PALLETS

[76] Inventor: Sydney Whitehorn, 31761 Arlington, Beverly Hills, Mich. 48009

[21] Appl. No.: 87,624

[22] Filed: Jul. 1, 1993

[51] Int. Cl.[6] ..... B08B 3/02

[52] U.S. Cl. ..... 15/309.2; 15/302; 15/316.1; 134/30

[58] Field of Search ..... 15/302, 306.1, 309.1, 15/309.2, 77, 56; 134/30

[56] References Cited

U.S. PATENT DOCUMENTS

| | | | |
|---|---|---|---|
| 1,617,833 | 2/1927 | Armstrong | 15/77 X |
| 1,714,075 | 5/1929 | Carvalho | 15/309.2 X |
| 2,651,065 | 9/1953 | O'Connor | 15/56 |
| 3,098,250 | 7/1963 | Creech | 15/77 |
| 3,178,745 | 4/1965 | Kleebauer | 15/77 |
| 3,289,238 | 12/1966 | Sorenson et al. | 15/306.1 |
| 3,694,847 | 10/1972 | Hetman et al. | 15/302 |
| 3,990,571 | 11/1976 | Kitterman et al. | 198/356 |
| 4,281,675 | 8/1981 | Pure | 134/125 |
| 4,807,319 | 2/1989 | Poitevin | 15/21 |
| 5,052,332 | 10/1991 | Hajek et al. | 15/309.2 X |
| 5,231,726 | 8/1993 | McKenney et al. | 15/77 X |

*Primary Examiner*—Christopher K. Moore
*Attorney, Agent, or Firm*—Howard & Howard

[57] ABSTRACT

A cleaning assembly (10) is designed to clean large heavy articles such as pallets (12). The cleaning assembly (10) is mobilized by four wheels (18) attached to base (16). A conveyor system (32) moves the articles (12) through the cleaning tunnel (33) wherein guiding railings (114) maintain the article (12) in the proper orientation throughout the cleaning process. A steam generator (72) produces steam (14) which is forced out of a plurality of sets (56) of spraying nozzles (58) at the article (23) such that the dirt and debris drops off the article (12). A conveyor belt (34) carrying the article (12) collects the fallen debris where it is scraped off by a scraper (118) and collected in a receptacle (120) for disposal.

12 Claims, 5 Drawing Sheets

STEAM CLEANING ASSEMBLY FOR CLEANING PALLETS

BACKGROUND ART

1. Technical Field

The subject invention relates to a cleaning assembly. More particularly, the subject invention relates to a cleaning assembly for cleaning large articles using high pressure steam.

2. Description of Related Art

The popularity of prepared, unpackaged foods has increased to the point where large food-related establishments, such as grocery stores and supermarkets, have offered soup and salad bars to its customers. These establishments, however, typically, do not have sufficient facilities to sanitize the containers and the food pallets holding the containers in accordance with public health codes. Even if these establishments do have the facilities to sanitize the food pallets, provisions in labor contracts often prevent workers from transporting such heavy articles across a store floor.

U.S. Pat. Nos. 3,990,571 and 4,281,675 issued to Kitterman et al and Pure, respectively, disclose tray washing machines which are permanent fixtures within a building. These systems both use water as a principal cleaning agent. Although water is very effective and accessible, it requires drainage facilities. Therefore, the washing assembly has to be affixed to a certain area near a drain or the washing assembly must have used water storage capabilities. The former option is not satisfactory because the weight of the food pallet is too great to transport between the washing assembly and the soup/-salad bar. The latter option is undesirable because the weight of the used water is inhibiting when moving the washing assembly to a drain.

U.S. Pat. No. 4,807,319, issued to Poitevin on Feb. 28, 1989, discloses a portable washing assembly for cleaning grocery carts. Again, this assembly is deficient in that it uses water which must be subsequently drained. Also, the water distribution system is lacking because the pressure at which the water is sprayed is so low that brushes and cleaning solutions are required to aid waterblasting when cleaning the grocery carts.

SUMMARY OF THE INVENTION AND ADVANTAGES

The subject invention is a portable cleaning assembly for cleaning articles. The portable cleaning assembly comprises a base including at least one wheel secured to the base for mobilizing the base. A tunnel defining a covered pathway is fixedly secured to the base and allows an article to pass therethrough. The tunnel includes two sidewalls and a top surface. Conveying means transports the articles through the tunnel wherein a plurality of sets of spray nozzles which are spaced equidistantly along the tunnel spray the articles. The portable cleaning assembly is characterized by steam generating means for generating steam to be sent through the plurality of sets of spray nozzles into the tunnel to clean the article as it passes through the tunnel on the conveying means allowing the portable cleaning assembly to operate in a location where the article is used.

The portable cleaning assembly provides a portable cleaning assembly reducing the amount of transportation needed for the articles or pallets to that of lifting the pallets from the soup/salad bar to the floor and then sending them through the machine. In addition, the subject invention eliminates the need to provide draining capabilities or used water storage facilities because the steam, which is the cleaning agent of the subject invention, combines with the residue on the pallets to produce a sludge which can be scraped off the base and conveying means of the subject invention without the accumulation of water.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

The subject invention is a portable cleaning assembly and is generally indicated at 10 in the Figures. The portable cleaning assembly 10 cleans articles 12. The preferred embodiment is designed to clean pallets 12 which are used to store open food therein although portable cleaning assembly 10 can be designed to clean any shaped article. A typical use of a pallet includes the holding of containers which store food to be used in soup and salad bars. The portable cleaning assembly 10 cleans the pallets 12 with a cleaning solution 14 comprised solely of steam. Depending on the application, the steam can be mixed with common cleaning agents such as soap, grease cutters, etc.

Figure 4:
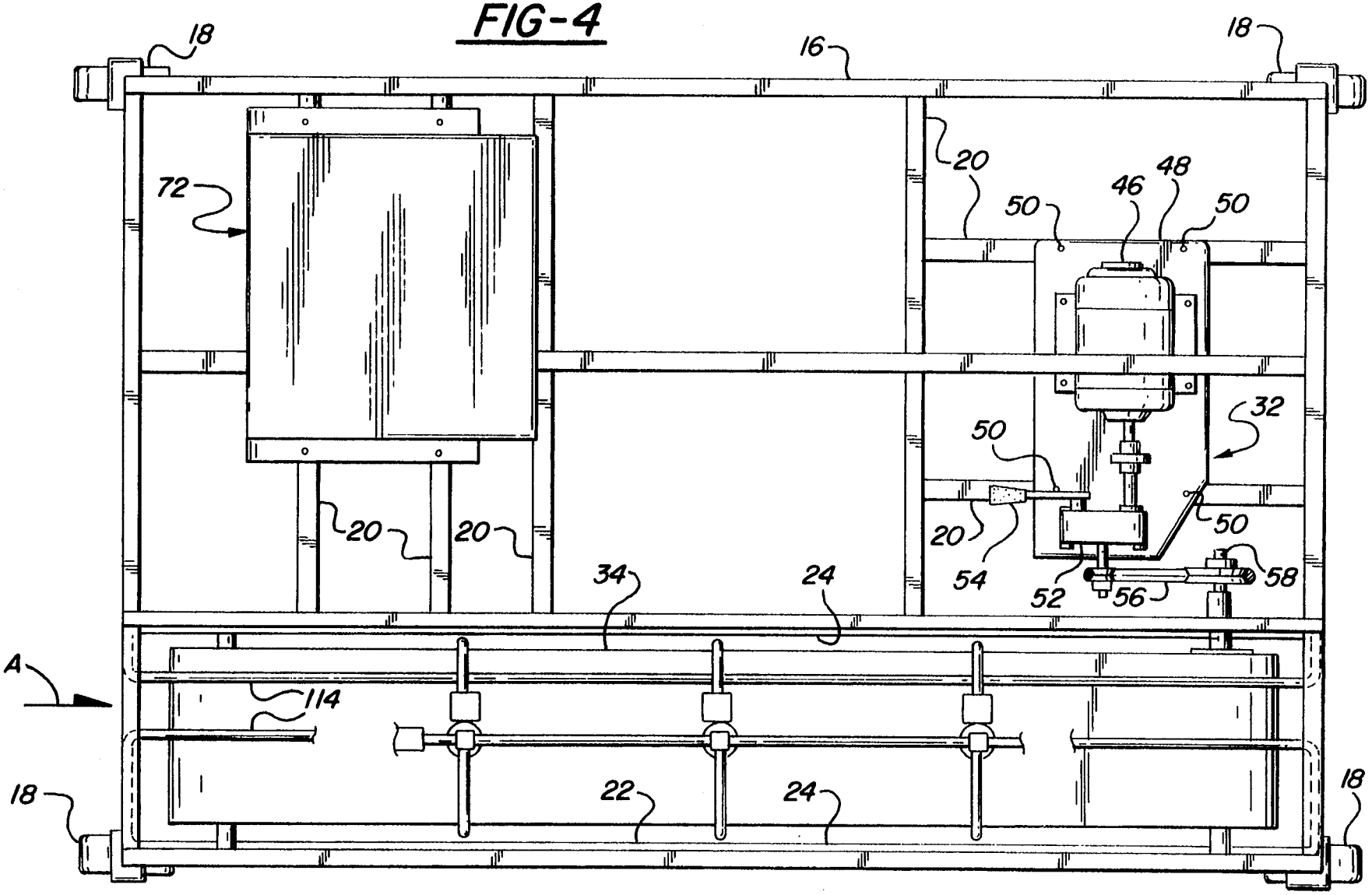
FIG. 4 is a top view of the preferred embodiment of the subject invention with the top surface removed therefrom.
Figure 5:
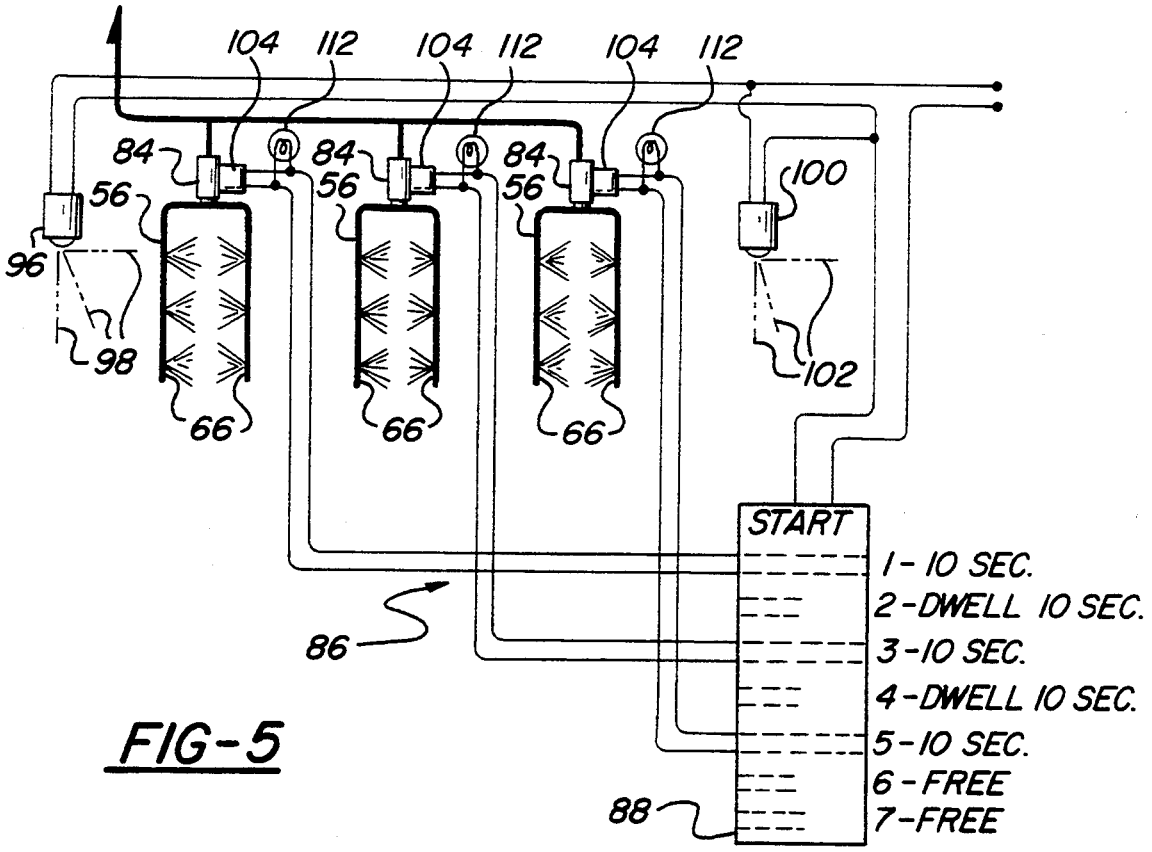
FIG. 5 is a partial schematic view and a partial side view of the timing mechanism for opening and closing the nozzles of the preferred embodiment of the subject invention.

The portable cleaning assembly 10 includes a base 16 having at least one wheel 18 secured thereto allowing said base 16 to be mobile. As may be best seen in FIG. 4, the base 16 includes a plurality of support beams 20 extending along the base 16 to provide support for the items supported by the base 16, all of which will be discussed subsequently.

The preferred embodiment of the subject invention 10 includes four wheels 18, one of each of the wheels 18 being located in each of the corners of the base 16. Two of the wheels 18 are rotatable about two perpendicular axes to increase the mobility of the pallet cleaning assembly 10.

Figure 2:
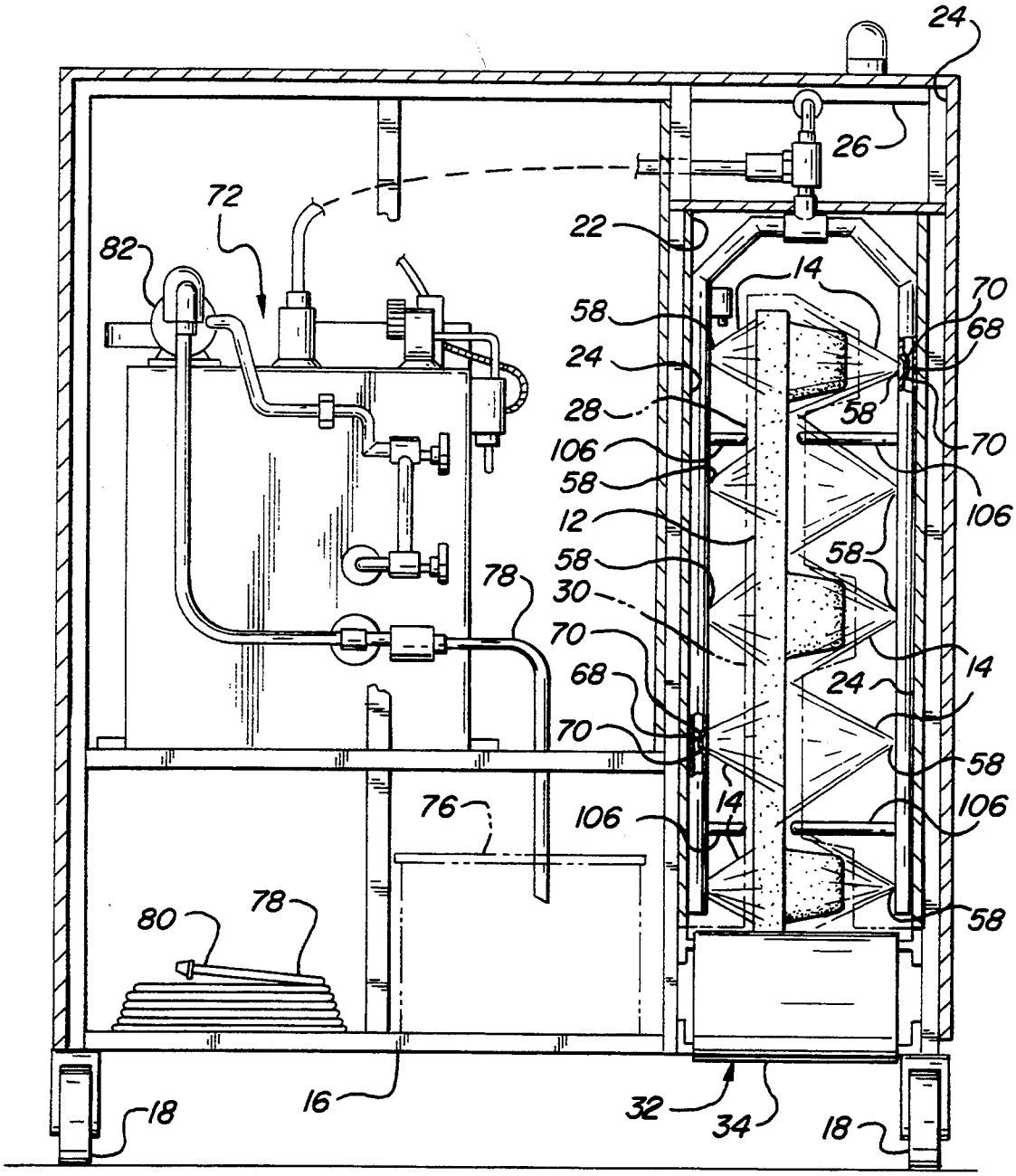
FIG. 2 is an end view, partially cut away, of the preferred embodiment of the subject invention.

A tunnel 22 defines a covered pathway fixedly secured to the base 16 to pass a pallet 12 therethrough. The tunnel 22 includes two sidewalls 24 and a top surface 26. The tunnel 22 is thermally insulated so anyone who might touch the outer sidewall 24 or the top 26 will not be burned from the heat of the steam. The tunnel 22 further includes two ends 28 (one shown in phantom in FIG. 2), each of which having an opening 30 substantially similar in cross-sectional design as that of the cross-sectional design of the pallets 12. The similar cross sections reduce the amount of area which is accessible reducing the risk of injury due to contact with the steam. Although not shown in the preferred embodiment, plastic strips may be used to further cover the openings 30. Such strips would be fixedly secured to a top portion of the sidewalls 24 wherein the strips would depend therefrom free to dangle and be moved aside by a pallet 12 being inserted into the openings 30 or exiting through an opening 30 after the pallet 12 has been cleaned.

Figure 3:
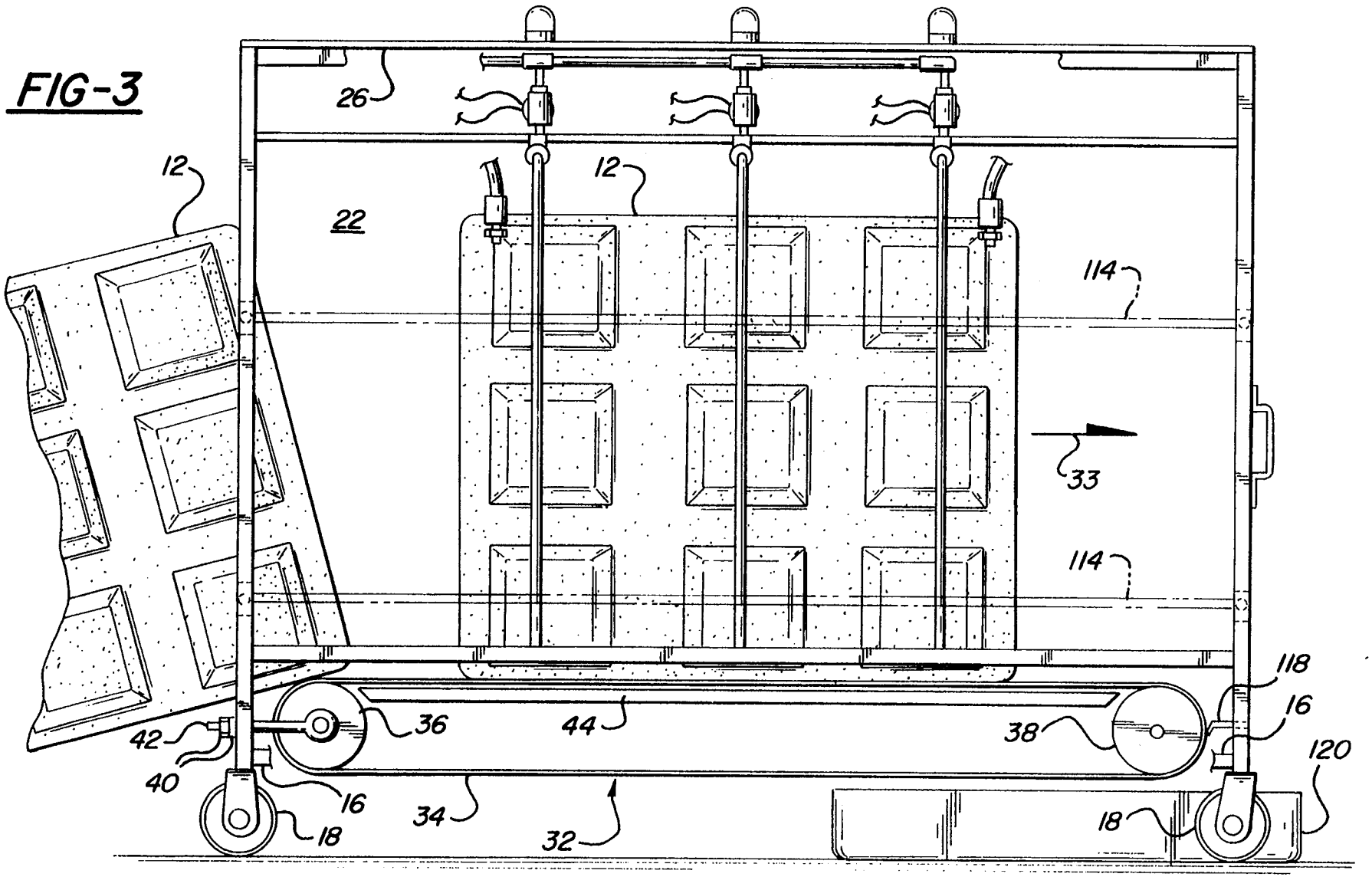
FIG. 3 is a cross-sectional side view of the preferred embodiment of the subject invention with two pallets passing therethrough.

Conveying means, generally indicated at 32, transports each of the pallets 12 through the tunnel 22. The conveying means 32 includes a rotating conveyor belt 34 which rotates about two rollers 36 and 38. The pallets 12 rest on the conveyor belt 34 and are moved through the tunnel 22 in the direction of the arrows 33. One of the rollers 36 is adjustable via two nuts 40 and stem 42 assembly wherein two nuts 40 lock the stem 42 in the desired axial position depending on whether the roller 34 is being set in place or whether the roller 36 is being loosened to remove or adjust the rotating conveyor belt 34, the latter having the stem 42 positioned to the right of its position shown in FIG. 3. A support rail 44 supports the weight of the pallets 12 as they pass over the rotating conveyor belt 34.

Figure 1:
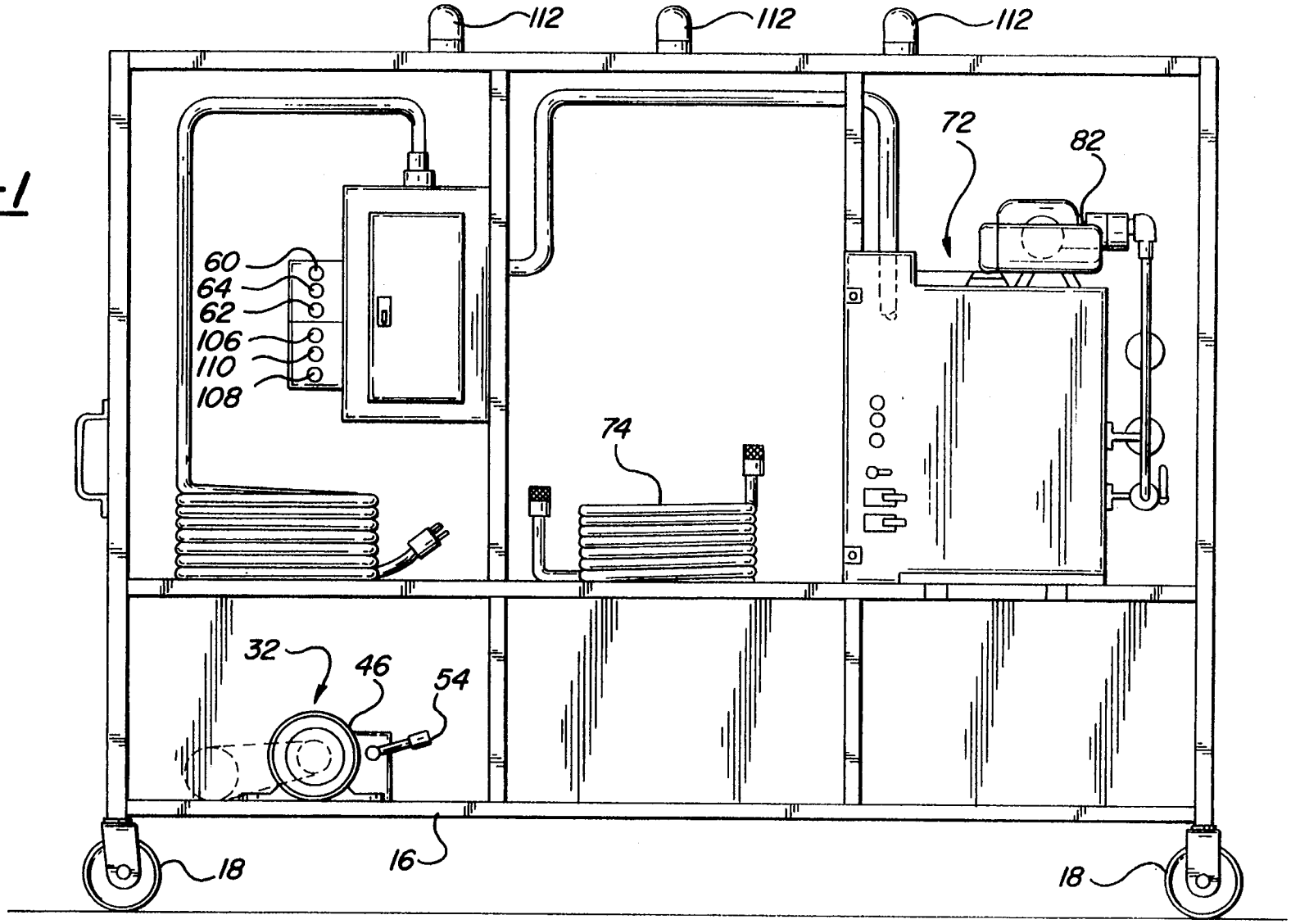
FIG. 1 is a side view of the preferred embodiment of the subject invention.

The conveying means 32 further includes a motor 46 for rotating the rotating conveyor belt 34. The motor 46 is secured to the base structure 20 using a plate 48. The plate 48 is secured to the base structure 30 via a plurality of fasteners 50. As may be seen in FIG. 4, there are four fasteners 50 which may be screws, rivets, weld spots, and the like. In the preferred embodiment, the motor 46 is a half horsepower standard gear motor operating at 1725 rpm and utilizing 115 V, single phase current at 60 Hz. A variable speed drive 52 is used to adjust the speed of the rotating conveyor belt 34. The variable speed drive 52 is operated by a handle 54 which adjusts the speed at which the rotating conveyor belt 34 travels. Once the variable speed drive 52 is adjusted to the desired speed, dependent upon each application, the variable speed drive 52 is locked into place and cannot be altered subsequently. The variable speed drive 52 is rated at 60 pounds for a one half horsepower motor and is connected through a belt 56 and van axle 58 to the roller 38. The motor 46 is turned on by pressing the on button 60, shown in FIG. 1, and turned off by pressing the off button 62. A pilot light 64 is located between the two buttons 60, 62 and emits light when the motor 46 is turned on.

A plurality of sets 56 of spray nozzles 58 are spaced equidistantly along the tunnel 22. Each of the plurality of sets 56 of spray nozzles 58 are located along the tunnel 22 such that each set 56 is operated at distinct time dependent upon the location of the pallet 12 as it passes through the tunnel 22. More specifically, when the pallet 12 first enters the tunnel 22, a first set 56 of spray nozzles 58 emits steam. When the pallet 12 proceeds along the tunnel 22, a second set 56 is activated. Finally, the pallet 12 is approaching the end of the tunnel 22, the third set 56 of spray nozzles 58 begins to emit steam 14 therefrom for a final cleaning. Although not shown, the subject invention 10 may include a fourth set of spray nozzles wherein cool air is blasted toward the pallets 12 to cool the pallets 12 before they exit the tunnel and are retrieved by the operator of the assembly 10.

Each of the sets 56 of spraying nozzles 58 include two branches of spraying nozzles 58 connected to each other at the top of the tunnel 11 and are fixedly secured to each of the side walls 24 of the tunnel 22. Each branch 66 directs steam 14 to each side of the pallet 12.

The spray nozzles 58 include a hole 68 in the branches 66 directed toward the rotating conveyor belt 34. Immediately surrounding the hole 68 is a flared surface 70 which enhances or increases the spray of the steam 14 as it leaves the hole 16.

The portable cleaning assembly 10 is characterized by steam generating means 72 for generating steam to be sent through the plurality of sets 56 of spray nozzles 58 and into the tunnel 22 to clean the pallet 12 as it passes through the tunnel 22 on the conveying means 32. The steam generator 72 receives its water supply from a hose 74 which is connectable between the steam generator 72 and a water supply faucet (not shown). The steam generator 72 includes the standard overflow, feed, and bypass valves as is common throughout all steam generators. Further, the steam generator 72 includes an electric heating element to heat the water received from the constant water supply into steam.

A boiler overflow tank 76 (FIG. 2) receives the overflow from the boiler through an overflow hose 78. The overflow tank 76 is removable for drainage. A spraying hose 78 is stored adjacent the boiler overflow tank 76 wherein the hose 78 includes a spraying nozzle 80 to concentrate steam at specific areas which need an extra concentration of steam directed thereto for greater periods of time.

The steam generator 72 further include pressure boosting means 82 for increasing the pressure at which the steam 14 is forced out of the spraying nozzles 58. The pressure boosting means 82 has been used to increase the pressure at which the steam 14 exits the spraying nozzles 58 because the type of debris deposited on the pallets 12, e.g., vegetable matter, salad dressings, soups, etc. are typically left alone for a great period of time before the pallet 14 can be cleaned thus resulting in the hardening of the food substance on the pallet 12.

The steam generating means 72 further includes a plurality of valving means 84 for operating each of the sets 56 of spray nozzles 58 independently of each other. The valving means includes three valves 84, each associated with each of the plurality of sets 56 of spray nozzles 58.

Figure 6:
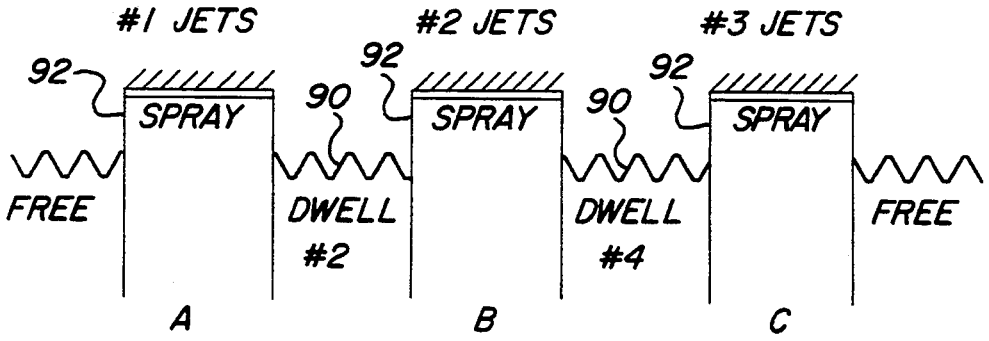
FIG. 6 is a graph representing the times in which the set of nozzles are turned on and off.

Timing means 86 opens and closes each of the plurality of valving means 84 at predetermined times independently of each other. As was discussed above, each of the sets 56 of spraying nozzles 58 operate independently of each other in that the time periods in which they are spraying are different and distinct time periods. The timing means 86 includes a seven stage timer 88 wherein a five stage timing sequence is produced having two dwell periods 90 with three active periods 92 such that each of the three active periods 92 send signals to each of the plurality of solenoids 94 (discussed subsequently) independently to open each of the plurality of valves 84 associated therewith. The three active periods 92 surround and separate the two dwell periods 90. The first of the three active periods 92, reference letter A in FIG. 6, begins the moment a line switch 96 is activated by a pallet 12 pushing the lever 98 of the line switch from an off position to an on position. The cycle, i.e., the last of the three active periods C, ends when a second line switch 100 has its lever 102 moved from the on position to the off position representing the pallet 12 passing thereby.

The seven stage timer 88 is a mechanical timing circuit wherein the rotation of cams disposed therein determines when each of the plurality of valves 84 operate. It would be obvious to those skilled in the art to replace the mechanical timer 88 with an electronic timer as such an alternative is a mere design choice.

The timing means 86 includes a plurality of solenoids 104, each associated with each of the valves 84 such that each of the solenoids 104 opens and closes each of the valves 84 at predetermined times. The solenoids 104 receive an electrical current from the seven stage timer 88 and open the valves 84 at that time. When the electrical current is removed by the seven stage timer 88, the plunger (not shown) associated with the solenoid 104 returns to its original position closing the valve 84 associated therewith.

The timing means 86 is turned on and off using buttons 106 and 108, respectively, with a pilot light 110 located therebetween indicating when the timing means 86 is turned on. Additionally, lights 112 indicate when the valve 84 associated therewith is in the open position.

The subject invention 10 further includes guiding means 114 for guiding the pallet 12 as it passes through the tunnel 22. The guiding means 114 includes at least two railings, one or either side of the conveying means 32, extending out from the sidewalls 24 of the tunnel 22 for maintaining the pallet 12 in a sideways orientation. The railings 114 maintain the pallet 12 in the proper orientation so the area covered by the steam spray 14 can be maximized with a great degree of certainty.

Scraping means 118 is fixedly secured to the base 20 and scrapes debris off the conveyor means 32. In other words, a scraping means 118 scrapes all the debris which falls to the rotating conveyor belt 34 where it is collected and disposed of using the receiving means 120. The receiving means 120 is removably secured to the base 20 adjacent the scraping means 118 and receives the debris scraped off the conveying means 32. Because a steam spray 14 is used as opposed to a water spray, the steam 14 loosens the debris on the pallet 12 and drops to the rotating conveyor belt 34. Negligible water collects and therefore no drain is required. Thus the receiving means 120, typically a pan, is a sufficient means for receiving and storing the debris until it is full at which time the tray 120 can be removed and the debris can be disposed of in a proper disposal container.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A portable cleaning assembly (10) for cleaning articles (12) with a cleaning solution (14), said portable cleaning assembly (10) comprising:

a base (16) including at least one wheel (18) secured to said base (16) for mobilizing said base (16);

a tunnel (22) defining a covered pathway fixedly secured to said base (16) to pass an article (12) therethrough, said tunnel (22) including two sidewalls (24) and a top surface (26);

conveying means (32) for transporting the article (12) through said tunnel (22);

a plurality of sets (56) of spray nozzles (58) spaced equidistantly along said tunnel (22);

steam generating means (72) for generating steam (14) to be sent through said plurality of sets (56) of spray nozzles (158) into said tunnel (22) to clean the article (12) as it passes through said tunnel (22) on said conveying means (32), said steam generating means (72) further including a plurality of valving means (84) for operating each of said plurality of sets of spray nozzles (58) independently of each other; and timing means (86) for opening and closing each of said plurality of valving means (84) at predetermined times independently of each other.

2. An assembly (10) as set forth in claim 1 further characterized by said valving means (84) including three valves (84), each of said three valves (84) associated with each of said plurality of sets (56) of spray nozzles (58).

3. An assembly (10) as set forth in claim 2 further characterized by said timing means (86) including a plurality of solenoids (104), each of said plurality of solenoids (104) associated with each of said plurality of valves (84) such that each of said plurality of solenoids (104) opens and closes each of said plurality of valves (84) at predetermined times.

4. An assembly (10) as set forth in claim 3 further characterized by said timing means (86) including a seven stage timer (88) having two dwell periods (90) alternating with three active periods (92) such that each of said three active periods signals each of said plurality of solenoids (104) independently to open each of said plurality of valves (84) associated therewith.

5. An assembly (10) as set forth in claim 4 further characterized by guiding means (114) for guiding the article (12) as it passes through said tunnel (22).

6. An assembly (10) as set forth in claim 5 further characterized by said guiding means (114) including two rails (114) extending out from said sidewalls (24) of said tunnel (22).

7. An assembly (10) as set forth in claim 6 further characterized by scraping means (118) fixedly secured to said base (16) for scraping debris off of said conveying means (32).

8. An assembly (10) as set forth in claim 7 further characterized by receiving means (120) removably secured to said base (16) adjacent said scraping means (118) for receiving the debris scraped off said conveying means (32) by said scraping means (118).

9. An assembly (10) as set forth in claim 8 further characterized by each of said plurality of sets (56) of spraying nozzles (58) including spraying nozzles (58) fixedly secured to each of said two sidewalls (24).

10. An assembly (10) as set forth in claim 9 further characterized by said steam generating means (72) including pressure boosting means (82) for increasing the pressure at which the steam (14) is forced out of said plurality of sets (56) of spraying nozzles (58).

11. An assembly (10) as set forth in claim 10 further characterized by said conveying means (32) including a rotating conveyor belt (34).

12. An assembly (10) as set forth in claim 11 further characterized by said conveying means (32) further including a motor (46) for rotating said rotating conveyor belt (34).

* * * * *